US011920470B2

(12) United States Patent
Herrick

(10) Patent No.: US 11,920,470 B2
(45) Date of Patent: Mar. 5, 2024

(54) STRADDLE SEAT PIT LAUNCH DIRECTIONAL DRILL

(71) Applicant: RODDIE, INC.

(72) Inventor: Rod Herrick, Kalispell, MT (US)

(73) Assignee: RODDIE, Inc., Columbia Falls, MT (US)

( * ) Notice: Subject to any disclaimer, the term of this patent is extended or adjusted under 35 U.S.C. 154(b) by 0 days.

(21) Appl. No.: 17/809,050

(22) Filed: Jun. 27, 2022

(65) Prior Publication Data

US 2022/0412166 A1 Dec. 29, 2022

Related U.S. Application Data

(60) Provisional application No. 63/215,557, filed on Jun. 28, 2021.

(51) Int. Cl.

| | |
|---|---|
| ***E21B 7/04*** | (2006.01) |
| ***E21B 3/02*** | (2006.01) |
| ***E21B 12/00*** | (2006.01) |
| ***E21B 19/083*** | (2006.01) |

(52) U.S. Cl.

CPC ..... *E21B 7/046* (2013.01); *E21B 3/02* (2013.01); *E21B 12/00* (2013.01); *E21B 19/083* (2013.01)

(58) Field of Classification Search

CPC . E21B 7/046; E21B 3/02; E21B 12/00; E21B 19/083

USPC ..... 175/62

See application file for complete search history.

(56) References Cited

U.S. PATENT DOCUMENTS

| | | | | |
|---|---|---|---|---|
| 3,554,298 | A | 1/1971 | Klein | |
| 5,125,460 | A * | 6/1992 | Behrens | E21B 7/046 173/52 |
| 5,205,671 | A | 4/1993 | Handford | |
| 6,109,831 | A | 8/2000 | Handford | |
| 6,196,470 | B1 | 3/2001 | Neumann | |
| 6,736,219 | B1 * | 5/2004 | White | E21B 19/16 173/4 |
| 9,353,573 | B2 | 5/2016 | Ebersole | |
| 9,556,691 | B2 | 1/2017 | Van Zee | |
| 10,982,497 | B1 | 4/2021 | Herrick | |
| 11,319,034 | B1 * | 5/2022 | Araki | B63B 45/04 |

(Continued)

FOREIGN PATENT DOCUMENTS

KR 102227835 B1 3/2021

OTHER PUBLICATIONS

Marketing Material [online; retrieved May 6, 2022] Company Name: Spartan Product: Spartan Tool 4" Bursting Head 82005000 COMPANY website: https://spartantool.com/spartan-tool-4-bursting-head-82005000/.

*Primary Examiner* — Taras P Bemko

(74) *Attorney, Agent, or Firm* — Robin Kelson Consulting, Inc.

(57) ABSTRACT

Disclosed are small model pit launch horizontal direction drills suitable for drilling a substantially horizontal bore hole and laying pipe underground from within a surface dug pit. The devices comprise a stationary frame and a carriage component competent to move forward and back along the frame and drill and retrieve an attached drill stem through an aperture in the frame. The carriage components are configured to allow an operator to straddle the carriage and operate the device from a seated position within the frame component interior.

20 Claims, 10 Drawing Sheets

(56) References Cited

U.S. PATENT DOCUMENTS

| | | | | |
|---|---|---|---|---|
| 11,512,579 | B2 * | 11/2022 | LaValley | E21B 7/022 |
| 2010/0193247 | A1 * | 8/2010 | Riddle | E21B 19/083 175/57 |
| 2014/0131113 | A1 * | 5/2014 | Ebersole | E21B 7/046 175/122 |
| 2017/0101832 | A1 * | 4/2017 | Ramos | E21B 19/083 |
| 2017/0175461 | A1 | 6/2017 | Maurer | |
| 2019/0047652 | A1 * | 2/2019 | Laberge | B62M 9/08 |
| 2020/0291729 | A1 | 9/2020 | Olander | |
| 2021/0237832 | A1 * | 8/2021 | Begin | B63B 34/10 |
| 2022/0411018 | A1 * | 12/2022 | Vaisanen | B60L 15/2009 |

* cited by examiner

STRADDLE SEAT PIT LAUNCH DIRECTIONAL DRILL

CROSS REFERENCE TO RELATED APPLICATIONS

This application claims the benefit of U.S. Patent Application U.S. Ser. No. 63/215,557, filed Jun. 28, 2021, the disclosure of which is hereby expressly incorporated in its entirety by reference herein.

FIELD OF USE

Embodiments of the present disclosure find applicability in the field of horizontal directional drilling. One useful field includes systems for placing gas, water, sewer, or other underground pipes, and/or for laying cable underground, including electrical, telephone and fiber optic cable.

BACKGROUND

Directional drilling machines and methods of use are well-known and well-characterized in the art. Also referred to in the art as boring, thrusting or horizontal drilling, the technology allows for the laying of pipe and cable underground (e.g., gas, water, sewer and drain pipes; ducts; power cables, telecommunication cables, including fiber optic cables, and the like) without needing to excavate or cut open the ground surface along the length of the pipe or cable to be installed. Typically, the process is executed by boring into the ground at an angle to a desired depth, then changing to a horizontal drilling direction. In "pit launched" applications, entry into the ground occurs from a first or "entry" access pit dug into the ground. For drilling distances on the order of 500 ft or less, and pipe or conduits of about 8-inches or less, the drill or boring apparatus can be placed inside the pit, and drilling occurs substantially horizontally from the start. The drill can gain its directional ability by means of an angled steering blade in the drill head behind which typically is a transmitter or locater beacon (e.g., "sonde" or GPS locator) that relays information to an above-ground operator so that drilling height and direction can be manipulated remotely to avoid obstacles and arrive at an intended location.

Directional boring machines are generally configured to drive a series of drill rods joined end-to-end to form a drill string. At the drilling destination, a second access pit or "exit" pit is provided. Alternatively, the destination can be inside or under a building, typically a basement or underground crawl space. When the drill head penetrates the second access/destination pit wall, the drill head is removed in the pit, and a pipe or conduit cable is attached to the drill string, optionally behind a rotating reamer head that serves to enlarge the bore as the pipe or cable is being pulled back through the bore by the retracting drill string. Once the pipe or cable is pulled through the bore hole to the entry access pit, it is disconnected from the drill string, and connected as desired to the service source and service receiver. Patent publications U.S. Pat. Nos. 10,982,497; 6,109,831; 5,205,671; 3,554,298; EP 0 904 461; and WO 2013/055389 are representative of the art.

Small model trenchless directional drills (having pullback ratings in the range of about 20,0000 pounds or less), currently make up over 60% of the horizontal directional drilling market. Pit launch models, characterized by a hydraulic drive motor that sits in the entry pit to be operated from within the pit, are particularly attractive for operations requiring in the range of about 5,000-20,000 pounds of pullback, drilling lengths in the range of less than about 1,000 ft, and small diameter pipe (typically about 4-inches or less). There is an on-going desire and need for developing small model pit-launched trenchless directional drills that are easy to operate, rugged, and provide the desired pull back capacity and speed without being cumbersome to transport and install.

Current pit launch models typically comprise a chassis or stationary frame that provides means for bracing the device against the front and back end of the entry pit, and a moveable component, typically comprising a hydraulic drive mechanism, that can move or slide the length of the chassis or stationary frame, and is competent to drive a drill stem into the ground from the pit to create a bore hole, and then pull the drill stem back into the pit, typically together with an attached pipe. Generally, the moveable hydraulic drive mechanism also has hydraulic controls for operator manipulation, generally from within the pit. Depending on the size of the pit and the pounds of pullback required, the pit launch device itself may sit within a larger metal box, sometimes referred to as a shoring box and can be stackable, which itself may define the entry pit.

The moveable components of pit launch models in the art generally rely on a glide system of some sort. For example, certain models are designed with the drive motor sliding along a central longitudinal beam that also provides support and stabilization during the drilling operation. Other glide systems have the drive motor suspended between the parallel walls of the chassis frame, and slide along on top of the frame. Commonly owned U.S. Pat. No. 10,982,497, the disclosure of which is expressly incorporated herein by reference, describes a pit launch device utilizing parallel mechanical linear actuator means to move the carriage along the frame, including a toothed rack and gear, or rack and pinion, system.

Current pit launch models in the art also are designed and fabricated to provide a small device footprint where possible, and ease of movability and positioning in an excavated launch pit. Typically, the operator stands next to the device, inside the pit, operating the drill stem longitudinal movement and rotational direction from a position outside the the pit launch device's stationary frame.

It is an on-going desire in the industry to provide for small model pit-launched horizontal directional drilling machines that are lightweight, compact, easy to install and set-up, easy for an operator to operate in the field, require minimal maintenance, particularly in the field, and which provide maximum life.

The present disclosure describes improvements in small model pit-launched directional drills and components thereof and methods of use that reduce the overall size and weight of the device, provide a smaller excavation foot print, and greater ease and comfort for operator use.

SUMMARY

This summary is provided to introduce a selection of concepts in a simplified form that are further described below in the Detailed Description. This summary is not intended to identify key features of the claimed subject matter on its own, nor is it intended to be used on its own as an aid in determining the scope of the claimed subject matter.

In accordance with one embodiment of the disclosure, provided herein is a pit launch device comprising a straddle seat allowing an operator to sit within the chassis frame of the device, and manipulate the device from a seated position. In another embodiment a pit launch device is provided with a reduced excavation foot print. In another embodiment, a pit launch device is provided wherein the carriage component height is in the range of about 24-36 inches. In still another embodiment, a pit launch device is provided having an overall width in the range of about 22 inches. In another embodiment the pit launch device disclosed herein has an overall length in the range of about 57 inches long. In still another embodiment, a pit launch device is provided with push and pull force in the range of about 8 tons. In still another embodiment, a pit launch device is provided wherein the operator can straddle the carriage component in a seated position and the device has a rotational torque in the range of about 800 ft-lbs. in still another embodiment the straddle seat device disclosed herein weighs in the range of about 700-800 lbs.

These and other attendant features and aspects of the present disclosure will be apparent from the drawings, detailed description and claims which follow.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
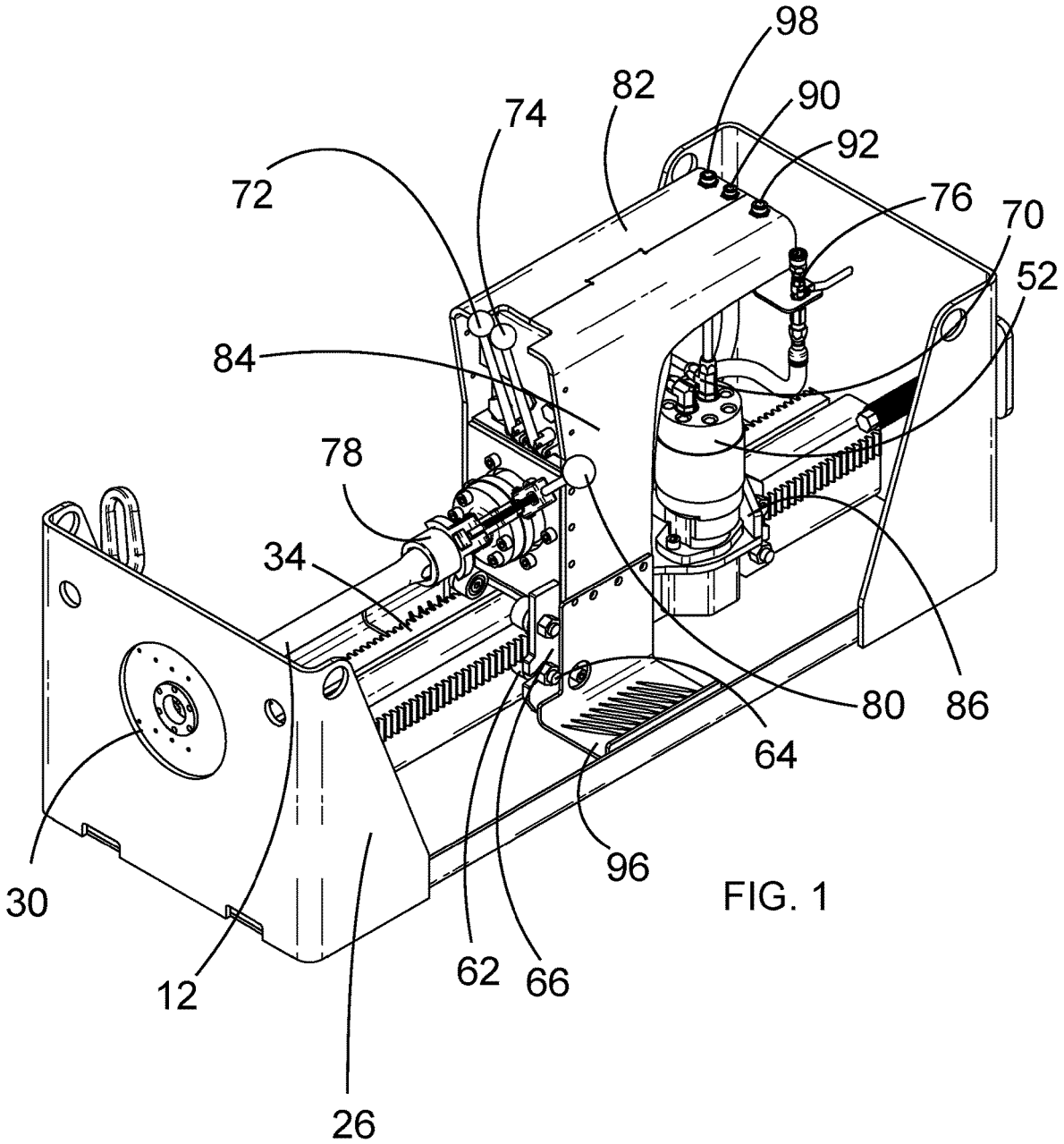
FIG. 1 illustrates an isometric front view of a straddle seat pit launch device according to an embodiment of the instant disclosure, with attached drill stem and carriage component in a first position.
Figure 2:
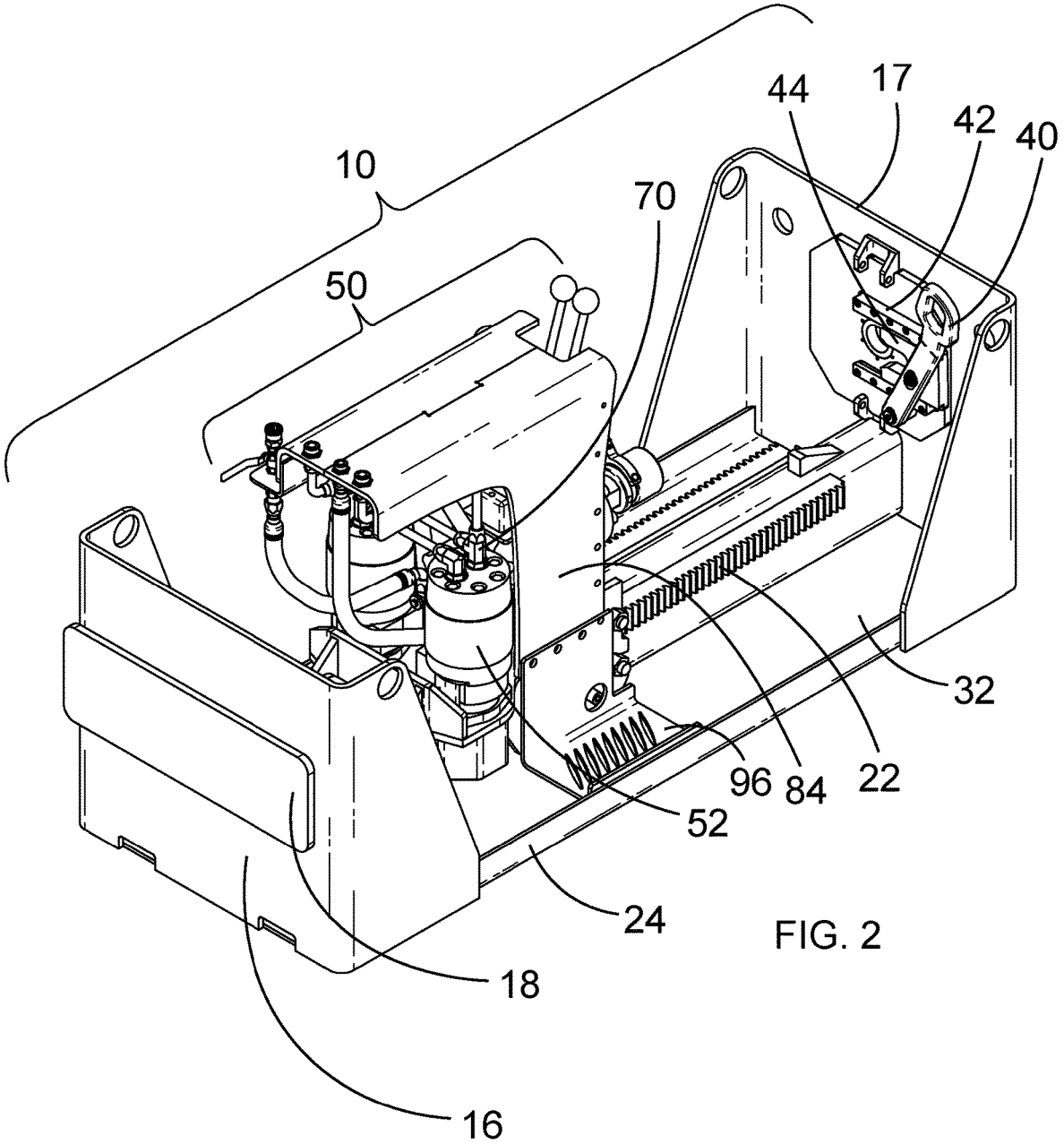
FIG. 2 illustrates an isometric back view of a straddle seat pit launch device according to an embodiment of the instant disclosure.
Figure 3:
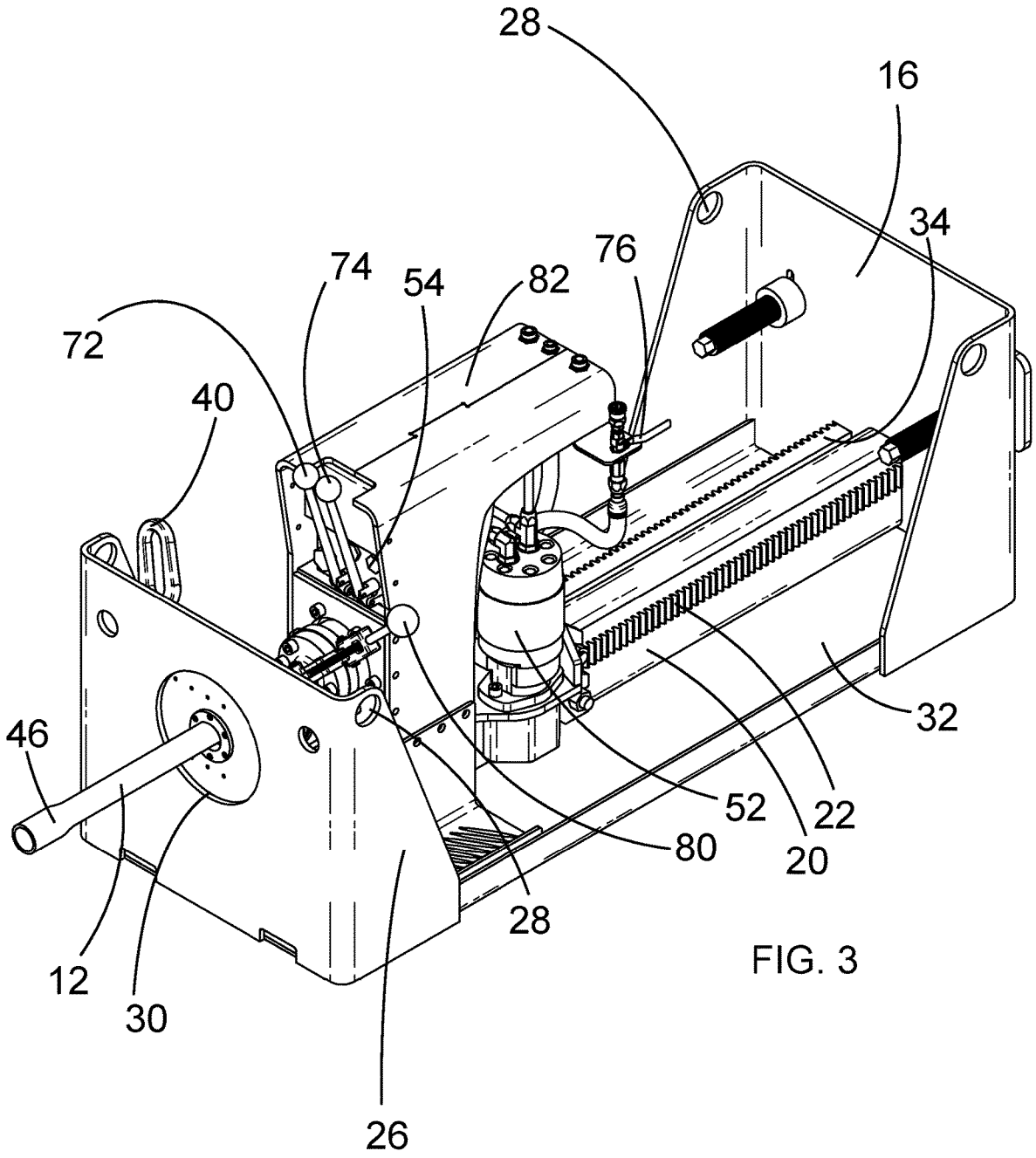
FIG. 3 illustrates the isometric front view of a straddle seat pit launch device of FIG. 1, with attached drill stem and the carriage component in a second position.
Figure 4:
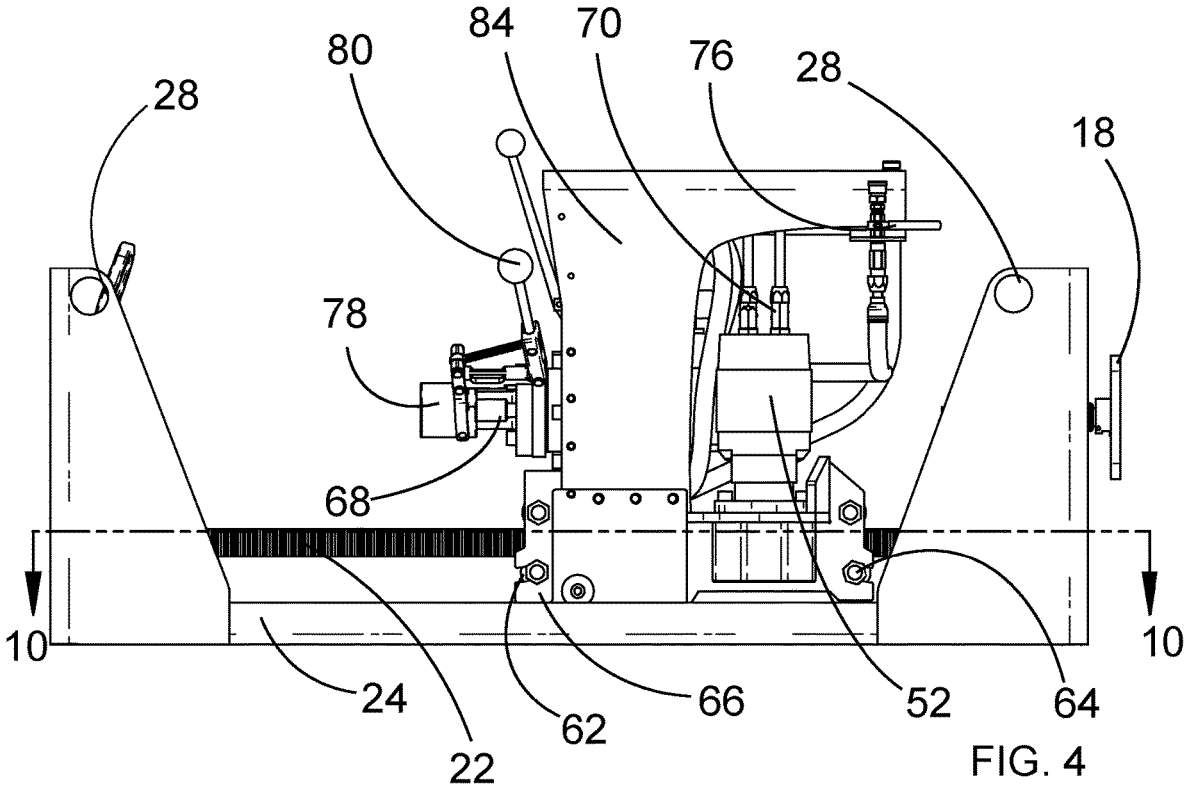
FIG. 4 illustrates a side view of a straddle seat pit launch device according to an embodiment of the instant disclosure.
Figure 5:
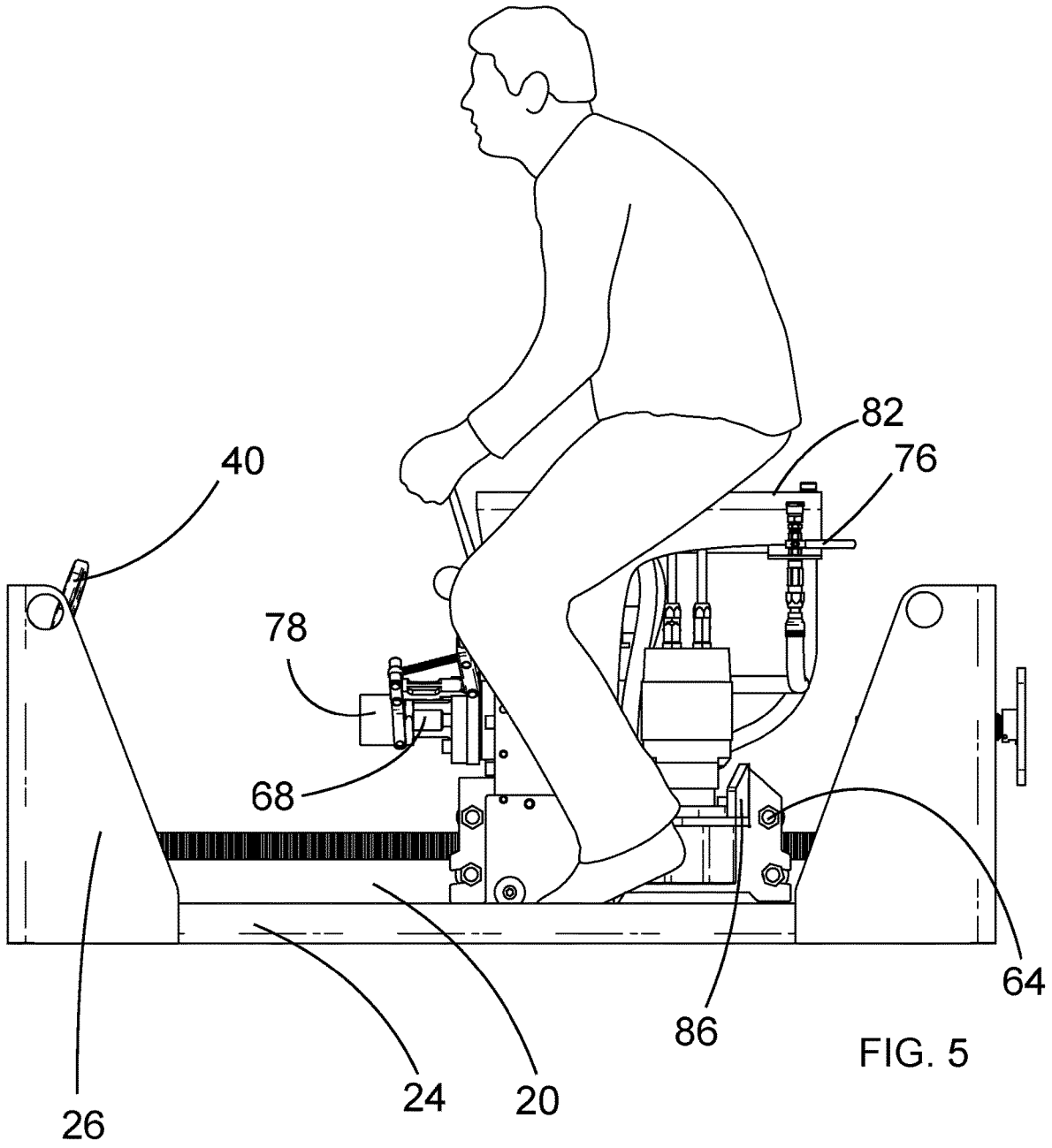
FIG. 5 illustrates a side view of an operator seated on a straddle seat pit launch device according to an embodiment of the instant disclosure.

Embodiments of the present disclosure provide devices, components, mechanisms and methods of use for directional drilling in confined spaces, and more particularly for horizontal directional drilling using a lightweight, portable, pit launch device having enhanced function and durability.

The pit launch hydraulic horizontal drilling devices disclosed herein are compact, lightweight and portable. Moreover, because the pit launch devices are designed so that the operator can straddle the carriage component located within the stationary frame, the pit paunch device disclosed herein can reduce the excavation foot print required for pit launches. In one embodiment, useful pit launch devices as disclosed herein can have a width in the range of about 22 inches and length in the range of about 57 inches. providing rotational torque in the range of at least about 800 ft-lbs, and capable of delivering drill stems or strings distances underground in the range of at least about 100-500 ft. The bore glide devices disclosed herein are useful trenchless installations for sewer laterals, water lines, gas, electric conduits and communication, including fiber optic.

Referring first to FIGS. 1-6, illustrative, exemplary embodiments of straddle seat pit launch device 10 (also referred to herein as a straddle seat bore glide) are provided. Device 10 can comprise a chassis component 14 and a carriage component 50 that engages with chassis component 14 via chassis 20 and can include an operator seat 82 and linear actuator drive, rotational drive, and steering control mechanisms.

Chassis component 14 can include a floor plate 32, back plate 16, front plate 17, and corner plate 26. Floor plate 32 can be solid and/or include one or a plurality of openings, which can be useful for allowing water to pass through. Back plate 16 also can include a moveable extension or tailstock 18 that can provide a device with enhanced flexibility for drilling in different size pits and drilling different length drill stems (e.g., 18-in, 2-ft and 3-ft). Chassis component 14 also can include a side frame lip 24.

Front plate 17 also can include an aperture 30 through which a drill stem 12 can be bored into the earth in a substantially horizontal manner, forming a drill string when drill stem stem joint 46 is coupled to another stem 12. Aperture 30 also can include a wiper plate which itself can have an aperture. Wiper plates can can be useful in wiping liquid and/or debris off a drill string, particularly when the drill string is being retrieved during a cable or conduit pulling operation. Corner plates 26 can include means for facilitating lifting and/or positioning of a device 10 in a pit. In the figures carry loop openings 28 provide openings through which a chain can pass, for example, or a hook engaged, so that the device can be lifted in and out of position by mechanical means, such as with a skid steer, for example.

Front plate 17 also can include a mechanism for easily and quickly breaking or cracking open pipe section joints created using devices of the present disclosure. Such a mechanism can be a rotation inhibiting element. One useful mechanism illustrated in the figures, includes a breakout wrench 40 with handle, a wrench jaw 44 which functions as a horseshoe wrench, and a linear slide means or wrench glide means 42 along which jaw 44 can move into position on the joint to be cracked. Jaw 44 can have flared or angled or chamfered edges that allow ease of positioning the wrench on the drill stem joint 46. Wrench 40's handle can be used to position jaw 44 on the joint. Slide or glide means 42 also can serve to limit lateral movement of the horseshoe wrench about the joint and thereby limit or otherwise inhibit excess rotation of wrench jaw 44 about the radial axis of the stem joint. The integrated breakout wrench system is disclosed in detail in U.S. Pat. No. 10,982,497. It will be appreciated by those skilled in the art that other mechanisms can be used to advantage.

Chassis 20 can be centrally located along the chassis component 14 longitudinal axis and can include the means for engaging with carriage component 50. As illustrated in the figures, the carriage engagement means can comprise a pair of parallel, opposing gear racks 22, also known as as toothed rods or bars, and which engage with the hydraulic gear drive mechanism on carriage component 50 using, for example, a rack and pinion gear system. Toothed racks having a substantially continuous, and substantially straight tooth profile, can be used to advantage. Gear racks 22 also can include a track roller glide surface 34 for engaging with track rollers or bearings on the carriage. Roller glide surfaces can include rails, I-channels and U-channels. In the embodiments illustrated, the parallel opposing gear racks face out from the lateral sides of chassis 20, each rack engaging with a rotating gear drive gear 60 on carriage component 50; each gear drive gear driven by an independent gear drive hydraulic motor 52 also on carriage component 50 (see below, and FIG. 7). Chassis 20 also can include a stop extending up from chassis 20's upper surface, at or near the front plate end of the device, also referred to herein and in the industry as the pit-face end of the device. The stop can engage with carriage component 50, including with gear drive back plate 86, to limit forward movement of carriage component 50 along chassis 20. Gear drive back plate or guard 86 also can be fabricated to provide structural stabilizing support for the carriage component and platform 88.

Figure 6:
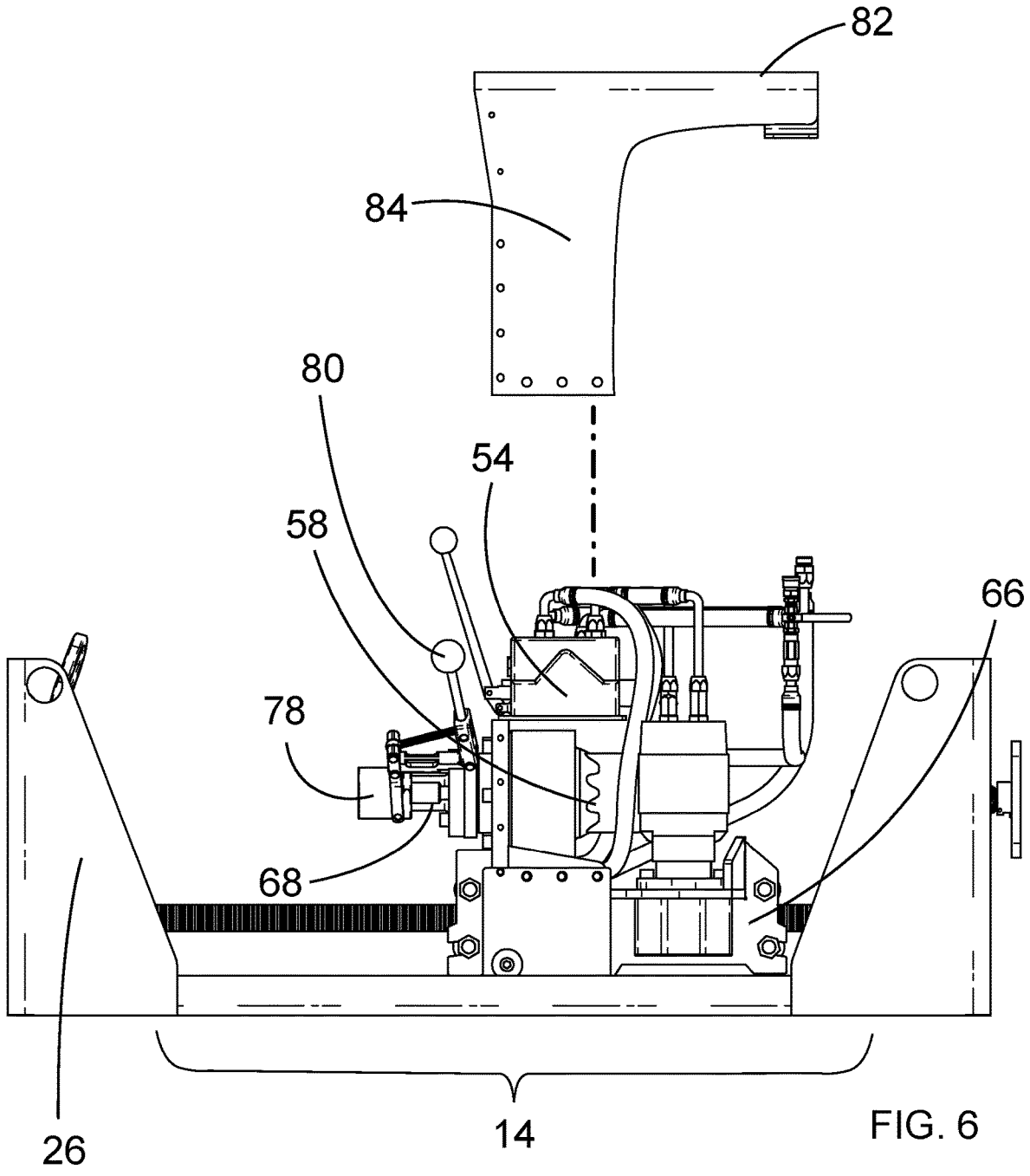
FIG. 6 illustrates an exploded side view of a straddle seat pit launch device according to an embodiment of the instant disclosure.
Figure 7:
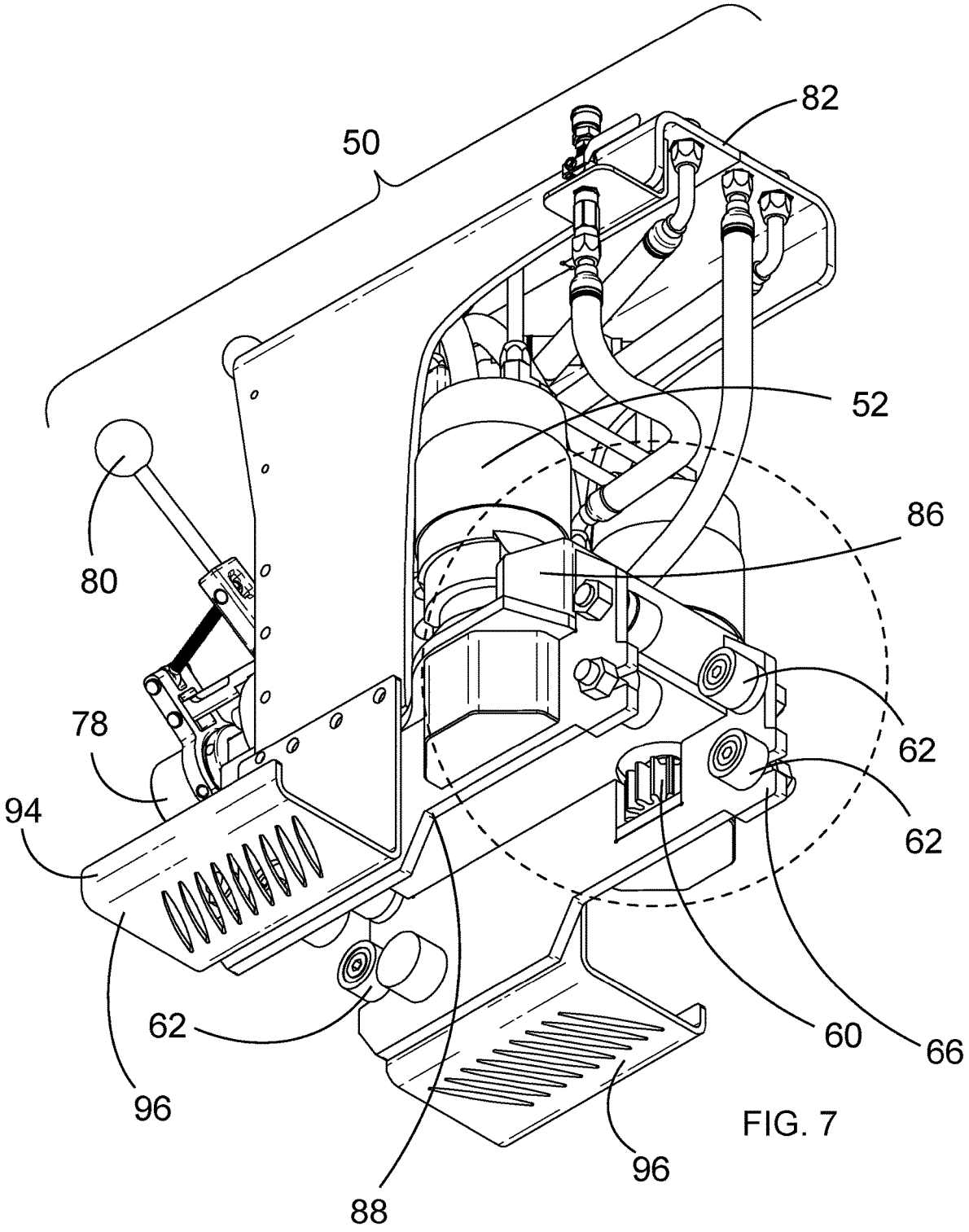
FIG. 7 illustrates a bottom right isometric view of a straddle seat pit launch device carriage component according to an embodiment of the instant disclosure.
Figure 8:
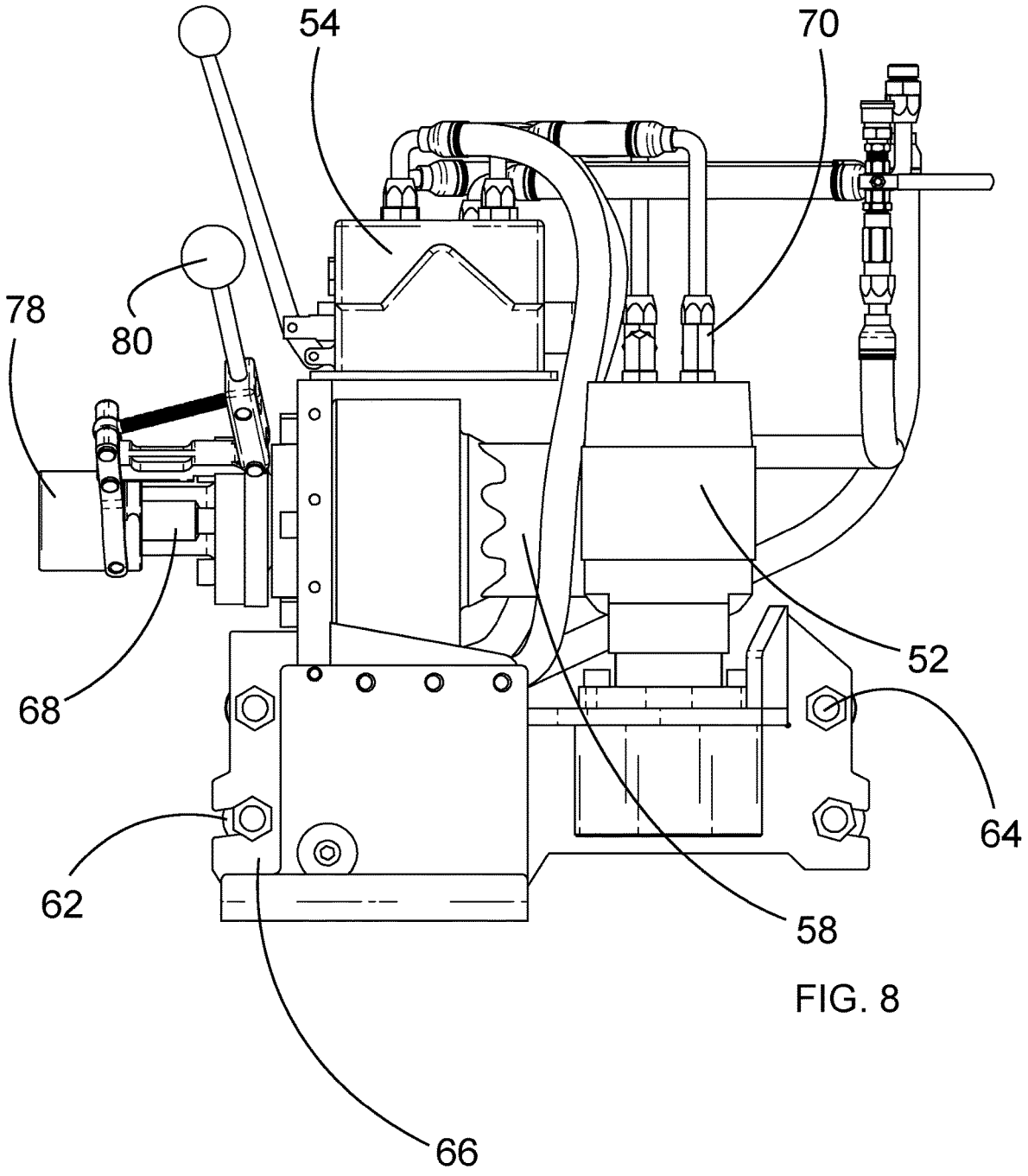
FIG. 8 illustrates a carriage component side view of a straddle seat pit launch device according to an embodiment of the instant disclosure.
Figure 9:
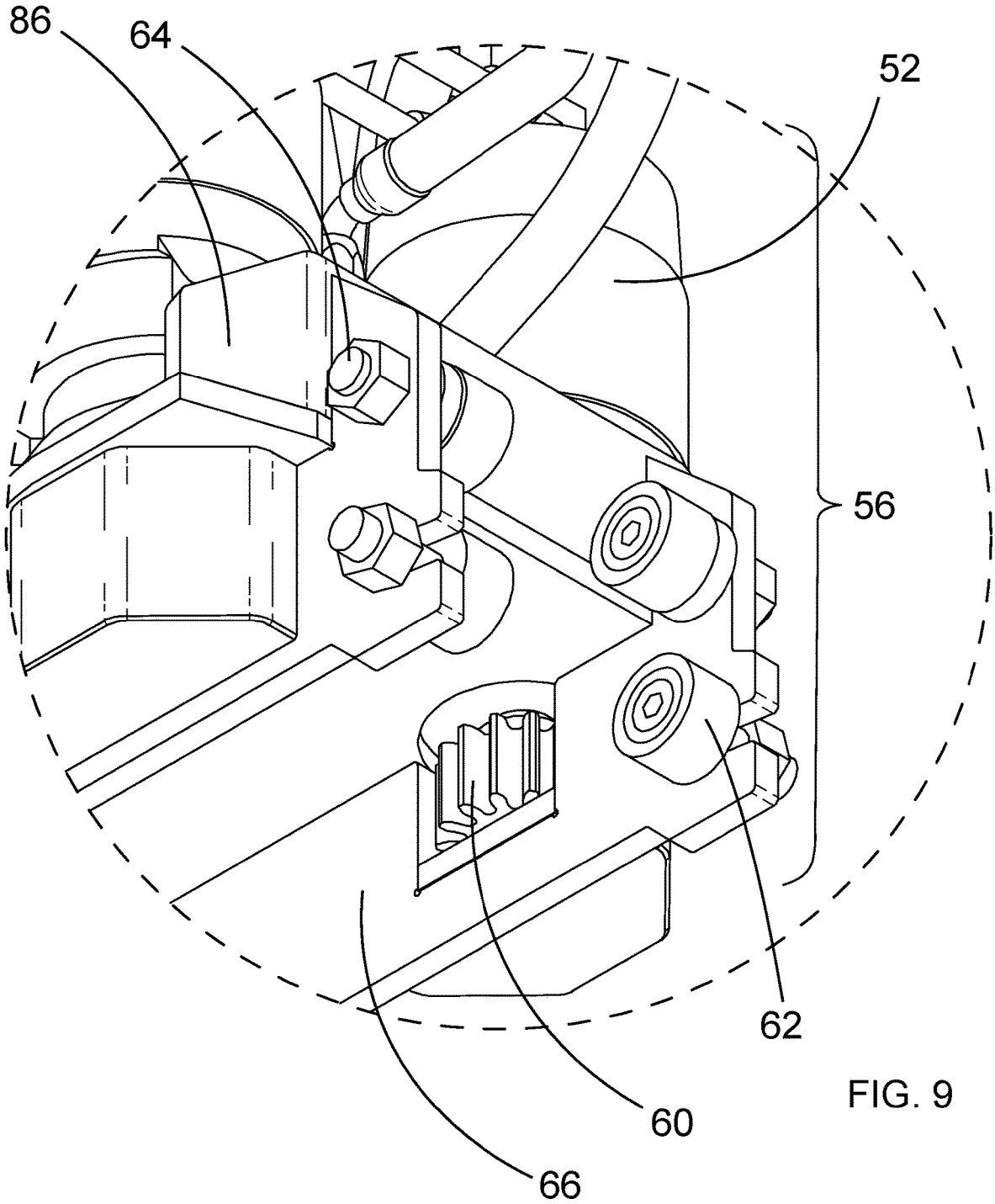
FIG. 9 illustrates an enlarged sectional view of a straddle seat pit launch device carriage component according to an embodiment of the instant disclosure.

FIGS. 6-10 depict illustrative, exemplary embodiments of carriage component 50. Referring first to FIG. 6-7, carriage component 50 can include an an operator straddle seat 82 on which an operator sits (see FIG. 5). Seat 82 can include straddle seat side frames 84 and foot plates 96 for the operator's feet to rest on. Foot plate 96 can include one or a plurality of openings useful for allowing liquid to pass through. Foot plate 96 can include any slip-resistant, durable surface, preferably permeable to liquid. Metal grill work surfaces can be used to advantage. Foot plate 96 also can include a lip 94 which can slide along chassis side frame lip 24. Foot plate 96 can be attached to straddle seat 82 by any standard means. In the figures, foot plate 96 is attached to straddle seat side frame 84 with standard bolting means.

In the embodiments illustrated, carriage component 50 can include a hydraulic gear drive mechanism 56 competent to move carriage component 50 forward and back along chassis 20, and a hydraulic rotational drive mechanism competent to drive the rotational motion of a drill stem in a clockwise or counter-clockwise direction as needed to add or remove an attached drill stem to or from a drill string. The drive mechanisms and the hydraulic steering gear unit 52 for directing hydraulic fluid flow into and out of the drives can be arranged on a carriage drive mechanism platform 88. In the figures, platform 88 can comprise a floor to which rotation drive motor 58 and gear drive motors 52 are secured, with parallel opposing side panels extending down from the platform floor. A gear back plate 86 extends up from the back end of platform 88, behind gear drive motors 58.

Referring to FIGS. 7-10, platform 88 floor and opposing side panels together can be dimensioned and configured to wrap around the top surface and two lateral sides of chassis 20. Gear drive motors 52 can be secured to platform 88 in parallel, opposing positions so that toothed gears 60 extend down from each of the two gear drive motors 52, through the floor of platform 88 and out from the inner side wall 66 of platform 88 side panel, and can engage with the chassis rack with which it associates. Vertically aligned pairs of rollers 62 can extend inward from the inside surface of each of platform 88's two side panels. Useful rollers can include cam follower bearings. The distance between the vertically aligned rollers can be dimensioned such the rollers occur above and below gears 60 on carriage component 50, and above and below chassis rack 22, such that the upper or superior roller of the pair rolls along the upper surface of rack 22, referred to herein as track roller glide surface 34, and the lower roller of the pair rides along the lower surface of rack 22, also a track roller glide surface. Track rollers 62 can be attached to platform side panels 66 by any standard means, including by means of bolts 64.

Figure 10:
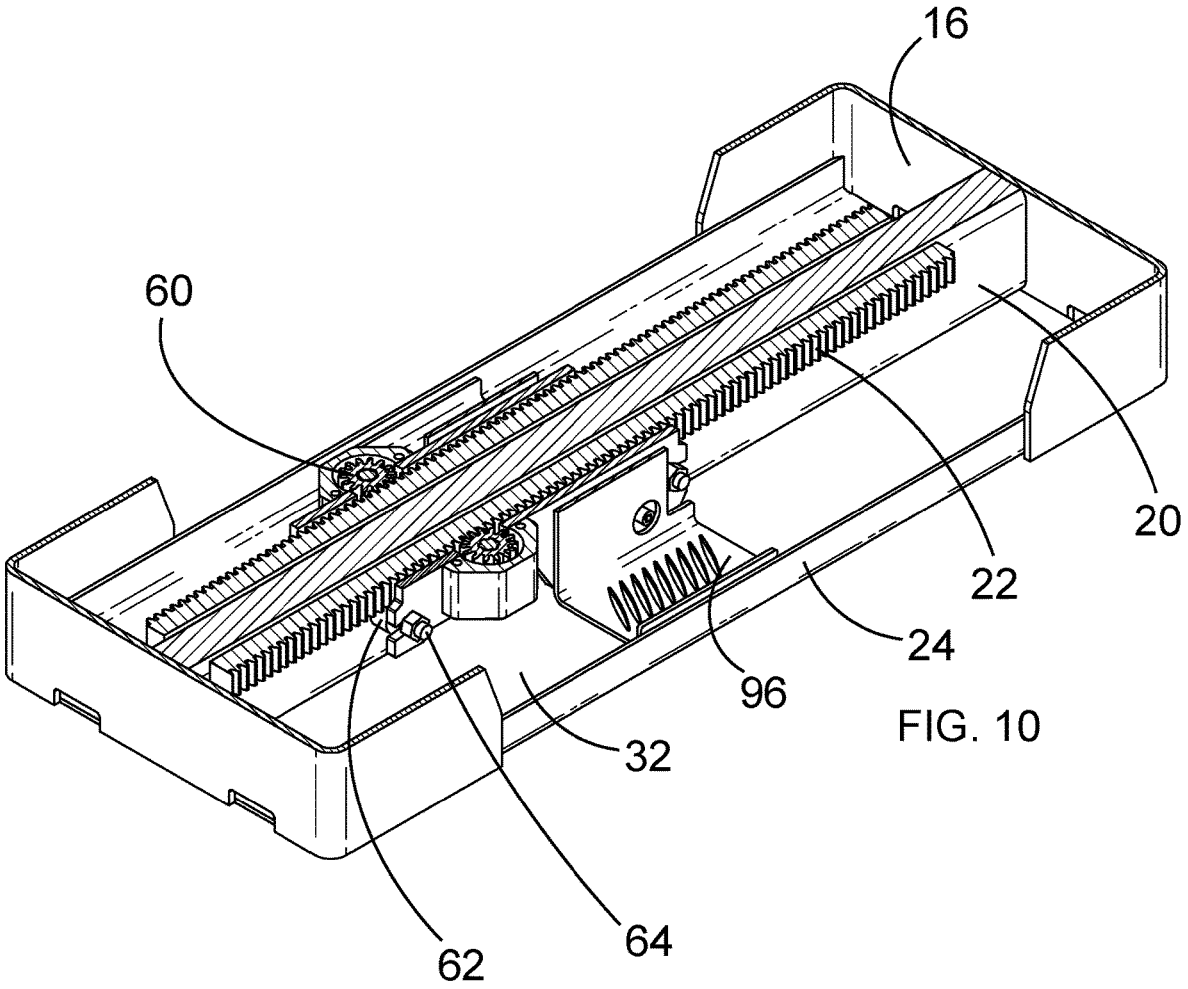
FIG. 10 illustrates a sectional view of a straddle seat pit launch device linear actuator means according to an embodiment of the instant disclosure.

FIG. 10 is a cross-sectional view illustrating this gear and rack engagement. Those skilled in the art will appreciate that the choice of the toothed rack and pinion gearing also can be varied, depending on the power needs of the operation. One useful gear ratio can be 1/6 or 1:6. Others can be used to advantage and can be determined by those having ordinary skill in the art, provided with the instant disclosure. For example, where greater thrust or pull back capability is desired, lower ratios may be selected including, without limitation, 1:8 or 1:10.

Rotational drive motor 58 can be positioned horizontally on platform 88, in front of drive motors 52, and hydraulic steering gear unit 54 positioned on top of rotational drive 58. In one embodiment, rotational drive motor 58 can be a single, direct drive motor that does not require a gear box. In the figures, steering gear unit 54 can include a joy stick, lever or other control means for manipulating the directions of the drives. For example, Lever 72 can control the direction of the two drive motors 52, directing movement of carriage component 50 forward and back along chassis 20. Lever 74 can control direction of drill stem rotation drive motor 58 such that the attached drill stem rotates clockwise, counterclockwise or not at all, as desired. As illustrated in the figures, levers 72 and 74 can be positioned and dimensioned for easy reach and manipulation by an operator seated on straddle seat 82, and straddle seat 82 can have an opening at its front end to accommodate the levers.

The figures illustrate one exemplary, non-limiting configuration of hydraulic hoses and couplers 70 for providing hydraulic fluid to and from the various motors and steering unit. It will be appreciated by those skilled in the art that other configurations can be fabricated and be effective. If desired, one or more source fluid couplers can extend up through one or more openings in straddle seat 82, as illustrated in FIG. 7, and straddle seat 82 and side frames 84 can act as a protective covering or casing for elements of carriage component 50. In the figures, a coupler for water valve 76, which can provide water to the drill head through the hollow drill stems attached to rotational motor drive 58, can extend up through straddle seat 82, as can a coupler for hydraulic fluid provided to pit launch device 10. In the event where a case drain is needed, (e.g., where a motor such as the rotational drive motor is a direct drive motor rather than a gear box motor) the drain coupler for removing excess fluid from the device also can advantageously extend up through the straddle seat.

As stated above, hydraulic motor 58 can translate rotational motion to an attached drill stem. Means for coupling drill stems to a rotational drive motor are well characterized in the art. One embodiment, illustrated here and described in detail in commonly owned U.S. Pat. No. 10,982,497, can include an integrated wrench collar pivot positioning mechanism. In the '497 patent, the disclosure of which is expressly incorporated herein by reference, the rotational drive motor can include a water spindle and associated drill stem adapter.

In horizontal drilling devices, wrench collars can be used to advantage to preferentially and selectively inhibit rotation of an attached pipe stem by collaring and holding the stem joint created between a stem pipe 12 and its carriage component attachment point. It will be appreciated by those skilled in the art that, when a direct drive motor is used for rotational drive, a functional stem adapter can be provided by bearings internal to the drive motor, eliminating the need for a standard stem adapter. In the illustrated embodiment, a free drill stem can be coupled to a stem adapter associated with the rotational drive. Wrench collar 78 is positionable on and off the formed stem joint by means of wrench collar handle 80. Collar 78 can be substantially hollow with an interior circumference dimensioned and contoured to engage with and hold the drill stem joint when positioned on the joint. This action, for example, can prevent undesired unthreading when pipe sections are being cracked open using a breakout wrench during pipe string retrieval.

Chassis dimensions can be built as desired. Dimensions need to accommodate drill stem, motors and gearing mechanisms, stacking components to allow for the optimum straddle seat height for an operator to straddle the carriage comfortably and provide for a narrow, shallow chassis component so that the operator's legs fit comfortably. One preferred chassis component width is in the range of about 22 inches. Device 10 can be placed in, braced against, and/or bolted to the front and back of an entry pit as is. Alternatively, device 10 can be placed inside a larger box or series of vertically stackable shoring boxes that provide the pit launch parameters. Choice of materials for chassis and drive unit fabrication are within the skill of the art to determine, with attention given to selecting materials of suitable strength, load capacity and durability, among other standard criteria.

EXAMPLES

Example 1

In operation, a straddle seat pit launch device is provided to an excavated pit. In one embodiment the excavated pit dimensions include a width in the range of about 30-48 inches and the pit launch device width is in the range of about 22 inches. In another embodiment the straddle seat height can be in the range of about 24-36 inches. The operator enters the pit and attaches hydraulic fluid source hose leads to couplers 90 and 92. If a case drain is needed, for example if a direct drive motor is used, a case drain extraction hose can be attached to coupler 98. A water source can be attached at coupler 76. Fluids are provided to the device by way of the couplers by personnel at the ground surface. Wearing a head set to communicate with a sonde reader at the ground surface, the operator positions him/herself on the straddle seat, with his/her feet in foot plates 96, and attaches a first provided drill stem to adapter 68, the drill stem having at its front end a drill head and sonde indicator. The operator then manipulates lever 72 to move carriage component 50 forward along chassis 12 until the drill head is at the pit face.

Seated on the straddle seat with his/her feet in the foot plates, the operator moves with the carriage component along chassis 20. When the carriage component is at or near its forward-most position on chassis 20, the operator engages the rotational drive by manipulating lever 74 so that the drill head can rotate as it drills into the ground surface at the pit face. The operator also can engage water valve 76 so that water is provided through the drill stem to the drill head. When the carriage component and the seated operator are at the forward-most position on chassis 20, the operator uncouples the drill stem from adapter 68 (see below) and manipulate lever 72 to move himself/herself and the carriage component back along chassis 20 to its first, drill stem re-set position.

Example 2

This example describes an operation embodiment utilizing the breakout wrench and mechanisms described herein to release drill stems from the carriage component once the drill stem has been coupled to an existing drill string and horizontally pushed, rotated or drilled into the earth until the carriage component is at or near the the chassis component front plate 17. During drilling, when the carriage is in a full forward position, a free drill pipe stem has been threaded onto and added to an existing drill string and the drill string has been drilled forward into the ground such that the carriage/pipe stem joint now is at or near front plate 17 and front plate aperture 30. This location is sometimes referred to in the art as the "pit face" and can define the forward-most or second limiting position for carriage component 50.

The carriage/pipe stem joint now needs to be cracked or broken open to release the drive unit from the drill string. Breakout wrench 40 is positioned on the joint by the operator, seated on straddle seat 82, typically by means of the wrench handle. The operator then engages the rotational hydraulic drive by means of lever 74 to rotate the drill stem, "breaking open" the joint and unthreading the stem from the drive unit. The drive unit now is released from the drill string. The operator then removes breakout wrench 40 from its joint position, again by maneuvering wrench 40's handle, and the carriage can be moved back to its rear-most position in the chassis (also referred to herein as the first limiting position) by the operator manipulating lever 72. At this first position, a new stem pipe is threaded onto the connection means associated with rotational drive motor 58 by the operator to form a new carriage/pipestem joint. The operator then engages carriage drive motors 52 by means of lever 72 to move carriage component 50 forward, and engages rotational drive motor 58 via lever 74 so the free stem joint end 46 of attached drill stem 12 pipe can be threaded onto the exposed and available stem end of the drilled string.

Once threaded onto the existing string, the operator manipulates the hydraulic drive unit again via lever 72 so the carriage moves forward again along the chassis longitudinal axis, drilling the newly added pipe into the earth, until the carriage reaches it second limiting position at the pit face again. The operator also can have opened water valve 76 during this step so that water flows through attached drill stem's hollow interior through the drill string to the drill head at the front of the drill string. When carriage component 50 is at the pit face, the operator can break open the carriage/pipe stem joint now at the pit face with assistance of breakout wrench 40, as before, and the process repeats until the desired drill string length as been created.

Example 3

In this example, one embodiment for retrieving drill stems is described using the wrench collar 78 disclosed herein. When a drill string is being retrieved, the joint between pipe stem adapter 68 and the drill string first can be cracked open by the operator on the straddle seat as described above in Example 2. The operator then positions collar 78 on the carriage/pipe stem joint by means of wrench collar handle 80, and then moves carriage component 50 back along chassis 20 by manipulating lever 72 until carriage component 50 is at the back end of cassis component 14, in its full re-set position, bringing with it the pipe string so that the next proximal forward pipe joint is retracted from the embedded bore hole in the earth and available to the drill stem joint wrench breakout system.

Breakout wrench 40 then can be used to crack open this newly exposed joint so that the newly exposed pipe stem can be easily unthreaded from the drill string. The operator then moves collar 78 off the carriage/pipe stem joint by means of handle 80 and manipulates the hydraulic rotational means lever 74 to unthread drill stem 12 from the carriage component 50. The free pipe is removed and the operator moves carriage component 50 forward along chassis 20 to the pit face. The operator engages the rotation drive motor to thread onto the newly exposed stem joint at the pit face, then uses collar handle 80 to position collar 78 onto the new carriage/pipe stem joint, and the carriage is pulled back again to retrieve the next stem. The operator uses the breakout wrench 40 and the jaw 44 mechanism to crack open the newly exposed stem joint, then moves the carriage back along the chassis to the chassis component back end, pulling the "cracked" drill stem with it.

Once in the full re-set position, the operator moves collar 78 off the carriage/pipe stem joint, and removes the free drill stem. The operator then moves the carriage forward to the exposed drill string free end, and engages the carriage rotational drive motor to the exposed free end of the drill string. The process and steps are repeated until the string is completely retrieved and the drill head or reamer, along with any attached pipe or conduit, have been pulled through the pit face and launch device front plate opening into the chassis interior.

It will be appreciated by those having skill in the art that the embodiments illustrated here are exemplary and that, provided with the instant disclosure, a range of means for constructing straddle seat pit launch devices now can be fabricated by one of ordinary skill in the art without undue experimentation. In the examples provided, it also will be appreciated that the order of steps are exemplary and illustrative and that some steps can occur concurrently or in a different order without negatively impacting the efficacy of the method described.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. A pit launch horizontal drilling device comprising:

b) a chassis component comprising a back plate, a front plate configured to allow passage of a drill bore therethrough, and a centrally located chassis joining said back plate to said front plate, said chassis including a top surface and lateral opposing sides, each said chassis side comprising a toothed rack having a continuous substantially straight tooth profile extending along the chassis longitudinal axis and, coupled thereto, c) a carriage component comprising a pair of laterally opposed toothed gears dimensioned and positioned to engage said chassis toothed racks as pinions, a hydraulic drive motor for rotating said toothed gears such that said carriage component can travel forward and back along said chassis toothed racks, a hydraulic rotary drive for releasably coupling to a drill stem end to form a drill stem joint and rotating said coupled drill stem in opposing directions, a straddle seat casing associated with said carriage component toothed gears such that said straddle seat casing can travel forward and back along said chassis toothed rack, said straddle seat dimensioned and configured to allow an operator to sit on said seat and operate said device, and hydraulic controls engaged with said hydraulic rotary drive and said hydraulic drive motor for directing rotation of said coupled drill stem and traversal of said carriage component along said chassis toothed racks, said controls being manipulatable by said operator when seated on said straddle seat such that said seated operator can travel forward and back at will on said carriage component in said chassis component.

2. The pit launch horizontal drilling device of claim 1 having a rotational torque in the range of about 800 ft-lbs.

3. The pit launch horizontal drilling device of claim 1 having an overall length in the range of about 57 inches.

4. The pit launch horizontal drilling device of claim 1 having an overall width in the range of about 22 inches.

5. The pit launch horizontal drilling device of claim 1, said carriage component having a height in the range of about 24-36 inches.

6. The pit launch horizontal drilling device of claim 1 having a push and pull force in the range of about 8 tons.

7. The pit launch horizontal drilling device of claim 1 wherein said hydraulic rotary drive means includes a positionable rotation inhibiting element configured to selectively engage a drill stem and limit rotation of said drill stem about a drill stem joint.

8. The pit launch horizontal drilling device of claim 7 wherein the positionable rotation inhibiting element comprises a collar configured to cover and engage said drill stem joint.

9. The pit launch horizontal drilling device of claim 1 wherein said chassis front plate further has associated with it a positionable rotation inhibiting element configured to selectively engage and grip a drill stem at said aperture.

10. The pit launch horizontal drilling device of claim 9 wherein the positionable rotation inhibiting element comprises a wrench element.

11. The pit launch horizontal drilling device of claim 1 wherein said straddle seat further comprises foot plates for said operator's feet.

12. The pit launch horizontal drilling device of claim 1 further comprising means for selectively delivering water through said drill stems to an attached drill head.

13. The pit launch horizontal drilling device of claim 1 wherein said straddle seat casing covers said hydraulic drive motor and said hydraulic rotary drive.

14. A method for drilling a bore hole underground in a substantially horizontal direction from a surface dug hole, the method comprising the steps of:

(a) providing a pit launch horizontal drilling device to said surface dug hole, said device comprising:

a chassis component comprising a back plate, a front plate configured to allow passage of a drill bore therethrough, and a centrally located chassis joining said back plate to said front plate, said chassis including a top surface and lateral opposing sides, each said chassis side comprising a toothed rack having a continuous substantially straight tooth profile extending along the chassis longitudinal axis and, coupled thereto, a carriage component comprising a pair of laterally opposed toothed gears dimensioned and positioned to engage said chassis toothed racks as pinions, a hydraulic drive motor for rotating said toothed gears such that said carriage component can travel forward and back along said chassis toothed racks between two limiting positions, a hydraulic rotary drive for releasably coupling to a drill stem end to form a drill stem joint and rotating said coupled drill stem in opposing directions, a straddle seat casing associated with said carriage component toothed gears such that said straddle seat casing can travel forward and back along said chassis toothed rack, said straddle seat dimensioned and configured to allow an operator to sit on said seat and operate said device, and hydraulic controls for directing rotation of said coupled drill stem and traversal of said carriage component along said chassis toothed racks, said controls being manipulatable by said operator when seated on said straddle seat such that said seated operator can travel forward and back at will on said carriage component in said chassis component;

(b) said operator on said straddle seat providing hydraulic power to said hydraulic rotating drive to engage a drill stem end and form a first drill stem joint;

(c) said operator on said straddle seat providing hydraulic power to said hydraulic motor to move said carriage component and said operator forward along said chassis until said first drill stem joint is at said aperture in said front plate and said carriage is at said second limiting position;

(d) said operator on said straddle seat positioning a first rotation inhibiting element on said drill stem at said aperture and reversing direction of said drill stem rotation to disengage said drill stem from said rotating drive means thereby leaving a free drill stem end at said aperture;

(e) said operator on said straddle seat moving said carriage component and said operator back along said frame to said first limiting position;

(f) said operator on said straddle seat providing one end of a new drill stem having two ends to said free drill stem end at said aperture and the second end to said hydraulic rotating drive;

(g) said operator on said straddle seat providing hydraulic power to said hydraulic rotating drive and said hydraulic motor, moving said carriage component and said operator forward while engaging said new drill stem, thereby forming a new first drill stem joint at said hydraulic rotating drive, and a second drill stem joint at said aperture;

(h) said operator on said straddle seat positioning said rotation inhibiting element off said drill stem at said aperture and moving said carriage component and said operator forward along said chassis until said first drill stem joint is at said aperture in said front plate, said second drill stem joint is in the bore hole, and said carriage is at said second limiting position;

(i) said operator on said straddle seat positioning said rotation inhibiting element on said new drill stem and reversing direction of said rotating drive to disengage said new drill stem from said rotating drive thereby leaving a free drill stem end at said aperture;

(j) said operator on said straddle seat moving said carriage component and said operator back along said frame to said first limiting position, and (k) said operator on said straddle seat repeating steps (f)-(j) until said bore hole is complete.

15. The method of claim 14 further comprising the steps of retrieving said drill stems from said bore hole by (l) providing said carriage component at said second limiting position, said hydraulic rotating drive coupled to a first drill stem end at said aperture via a first said drill stem joint, said first rotation limiting element disengaged from said first drill stem;

(m) providing hydraulic power to said hydraulic motor to move said carriage component and said operator back along said chassis until a said second drill stem joint and associated second drill stem is retrieved from said bore hole and at said aperture;

(n) positioning said first rotation inhibiting element on said second drill stem joint at said aperture and a second rotation inhibiting element on said first drill stem joint at said hydraulic rotating drive and rotating said drill stem in an uncoupling rotation to disengage said second drill stem;

(o) retracting said second rotation inhibiting element from said first drill stem joint, disengaging said second rotation inhibiting element from said first stem joint, and continuing uncoupling rotation to disengage said drill stem from said rotating drive means, and (p) repeating steps (l)-(o) until all drill stems are retrieved from said bore hole.

16. The method of claim 15 wherein said second rotation inhibiting element is associated with said hydraulic rotary drive and comprises a positionable wrench collar configured to selectively engage and hold said first stem joint.

17. The method of claim 16 wherein said positionable wrench collar is competent to prevent pipe stem unthreading at said first stem joint.

18. The method of claim 14 wherein first rotation inhibiting element is associated with said front plate and comprises a positionable wrench element configured to selectively grip a drill stem.

19. The method of claim 14 wherein said device further comprises means for selectively providing water through said drill stems to an attached drill head, and said operator activates said water providing means while moving said carriage component forward along said chassis.

20. The method of claim 14 wherein said straddle seat casing covers said hydraulic drive motor and said hydraulic rotary drive.

* * * * *